US011933169B1

(12) United States Patent
Duthie et al.

(10) Patent No.: US 11,933,169 B1
(45) Date of Patent: Mar. 19, 2024

(54) ROBOTIC UNTETHERED SIDEWALL CORING TOOLS

(71) Applicant: SAUDI ARABIAN OIL COMPANY, Dhahran (SA)

(72) Inventors: Laurie S. Duthie, Ras Tanura (SA); Mohammad S. Dabbous, Qatif (SA); Abdulaziz A. Al-Anizi, Manifa (SA); Karam Yateem, Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/938,636

(22) Filed: Oct. 6, 2022

(51) Int. Cl.

| | |
|---|---|
| ***E21B 49/06*** | (2006.01) |
| ***E21B 17/10*** | (2006.01) |
| ***E21B 47/04*** | (2012.01) |
| ***E21B 47/07*** | (2012.01) |

(52) U.S. Cl.
CPC ..... *E21B 49/06* (2013.01); *E21B 17/1078* (2013.01); *E21B 47/04* (2013.01); *E21B 47/07* (2020.05); *E21B 2200/08* (2020.05)

(58) Field of Classification Search
CPC ..... E21B 49/06; E21B 47/04; E21B 47/07; E21B 2200/08; E21B 17/1078
See application file for complete search history.

(56) References Cited

U.S. PATENT DOCUMENTS 2,798,378 A 7/1957 Del Americo et al.
4,354,558 A * 10/1982 Jageler ..... E21B 49/06 175/45
5,617,927 A 4/1997 Maissa
7,762,328 B2 * 7/2010 Tchakarov ..... E21B 49/10 166/264
8,408,332 B2 4/2013 Reid, Jr. et al.
(Continued)

FOREIGN PATENT DOCUMENTS

EP 0030970 B1 3/1985
KR 101061400 B1 9/2011

OTHER PUBLICATIONS

Buzi, Erjola, Seren, Huseyin Rahmi, Deffenbaugh, Max, Turner, Robert, and Ali Ssafwany. "Sensor Ball: An Autonomous Untethered Logging Platform." Paper presented at the Offshore Technology Conference, Houston, Texas, USA, May 2020.

*Primary Examiner* — Tara Schimpf
*Assistant Examiner* — Jennifer A Railey
(74) *Attorney, Agent, or Firm* — Vorys, Sater, Seymour and Pease, LLP

(57) ABSTRACT

A coring tool includes an electronics section that includes a material that is buoyant in a wellbore fluid, a coring section coupled to the electronics section and including a sidewall coring unit operable to penetrate an inner wall of a wellbore and thereby obtain a core sample, and a stabilizer arm assembly operable to laterally extend a stabilizer arm into engagement with the inner wall of the wellbore. A weight section is operatively coupled to the electronics and coring sections and exhibits a weight that overcomes buoyancy forces generated by the buoyant material in the wellbore fluid, and a release mechanism releasably attaches the weight section to the electronics and coring sections. Activating the release mechanism detaches the weight section, and thereby allows the electronics and coring sections to float in the wellbore fluid and ascend the wellbore.

20 Claims, 5 Drawing Sheets

(56) References Cited

U.S. PATENT DOCUMENTS

| | | | | |
|---|---|---|---|---|
| 8,919,460 | B2 * | 12/2014 | Joulin | E21B 4/02 175/58 |
| 10,378,347 | B2 | 8/2019 | Massey | |
| 2006/0081398 | A1 * | 4/2006 | Arian | E21B 49/06 175/58 |
| 2011/0094801 | A1 * | 4/2011 | Buchanan | E21B 4/04 175/249 |
| 2016/0320769 | A1 * | 11/2016 | Deffenbaugh | E21B 23/10 |
| 2017/0204726 | A1 | 7/2017 | Leeampion et al. | |
| 2019/0169954 | A1 * | 6/2019 | Cabot | E21B 27/02 |
| 2021/0404305 | A1 * | 12/2021 | Winkler | E21B 43/27 |

* cited by examiner

ROBOTIC UNTETHERED SIDEWALL CORING TOOLS

FIELD OF THE DISCLOSURE

The present disclosure relates generally to core sampling in the oil and gas industry and, more particularly, to robotic, untethered sidewall coring tools and methods of deploying, operating, and retrieving the same.

BACKGROUND OF THE DISCLOSURE

In the oil and gas industry, wells are generally drilled into the ground or ocean floor to recover natural deposits of oil and gas, as well as other desirable materials that are trapped in subterranean geological formations. A well is typically drilled using a drill bit attached to the lower end of a drill string, and drilling fluid or "mud" is typically pumped through the drill string to the drill bit. As it exits the drill bit, the drilling fluid lubricates and cools the drill bit, and it carries drill cuttings back to the surface in the annulus between the drill string and the wellbore wall. Once a subterranean formation of interest is reached, drillers will often investigate the formation and its contents and characteristics through the use of one or more downhole formation evaluation tools.

There are many challenges related to the understanding of reservoir formation characteristics. Wireline logging and logging-while-drilling (LWD) methods, for example, have the capabilities to provide detailed petrophysical data. However, physical core samples from subterranean formations can be essential to calibrate and confirm the actual rock characteristics. Core samples are analyzed to identify reservoir quality, storage and flow capacity, rock grain size and density, mineralogical information, relative permeability and rock characterization, etc.

Conventional coring operations frequently employ coring tools on drill pipe, which has the benefit of returning large core samples for analysis. However, it can be time consuming to run and retrieve drill pipe downhole (i.e., trip in and out of hole), and this can further become a costly exercise considering the total cost of rig operations. Another common type of coring operations is sidewall rotary coring, which can be deployed on wireline. While sidewall coring on wireline is a faster and more cost-effective method than coring with drill pipe, a large amount of equipment and personnel are nonetheless required for these operations.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, A well system can include a wellbore extending from a well surface location and penetrating a subterranean formation, the wellbore being filled with a wellbore fluid, and a coring tool untethered from the well surface location and conveyable to a bottom of the wellbore under gravitational forces. The coring tool can include an electronics section that includes a buoyant material that is buoyant in the wellbore fluid, a coring section coupled to the electronics section and including a sidewall coring unit operable to penetrate an inner wall of the wellbore and thereby obtain a core sample, and a weight section operatively coupled to the electronics and coring sections at a release mechanism. A weight of the weight section may overcome buoyancy forces generated by the buoyant material in the wellbore fluid, and activating the release mechanism detaches the weight section and allows the electronics and coring sections to float to the well surface location.

According to another embodiment consistent with the present disclosure, a coring tool can include an electronics section that includes a buoyant material that is buoyant in a wellbore fluid, and a coring section coupled to the electronics section. The coring section may include a sidewall coring unit operable to penetrate an inner wall of a wellbore and thereby obtain a core sample, and a stabilizer arm assembly operable to laterally extend a stabilizer arm into engagement with the inner wall of the wellbore. The coring tool may further include a weight section operatively coupled to the electronics and coring sections and exhibiting a weight that overcomes buoyancy forces generated by the buoyant material in the wellbore fluid, and a release mechanism that releasably attaches the weight section to the electronics and coring sections, wherein activating the release mechanism detaches the weight section, thereby allowing the electronics and coring sections to float in the wellbore fluid and ascend the wellbore.

According to another embodiment consistent with the present disclosure, a method of operating a well system can include introducing a coring tool into a wellbore extending from a well surface location and penetrating a subterranean formation, the wellbore being filled with a wellbore fluid and the coring tool being untethered from the well surface location. The coring tool may include an electronics section that includes a buoyant material that is buoyant in the wellbore fluid, a coring section coupled to the electronics section and including a stabilizer arm assembly and a sidewall coring unit, and a weight section operatively coupled to the electronics and coring sections and exhibiting a weight that overcomes buoyancy forces generated by the buoyant material in the wellbore fluid. The method may further include conveying the coring tool toward a bottom of the wellbore under gravitational forces, activating a release mechanism and thereby detaching the weight section from the electronics and coring sections, and floating the electronics and coring sections to the well surface location.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
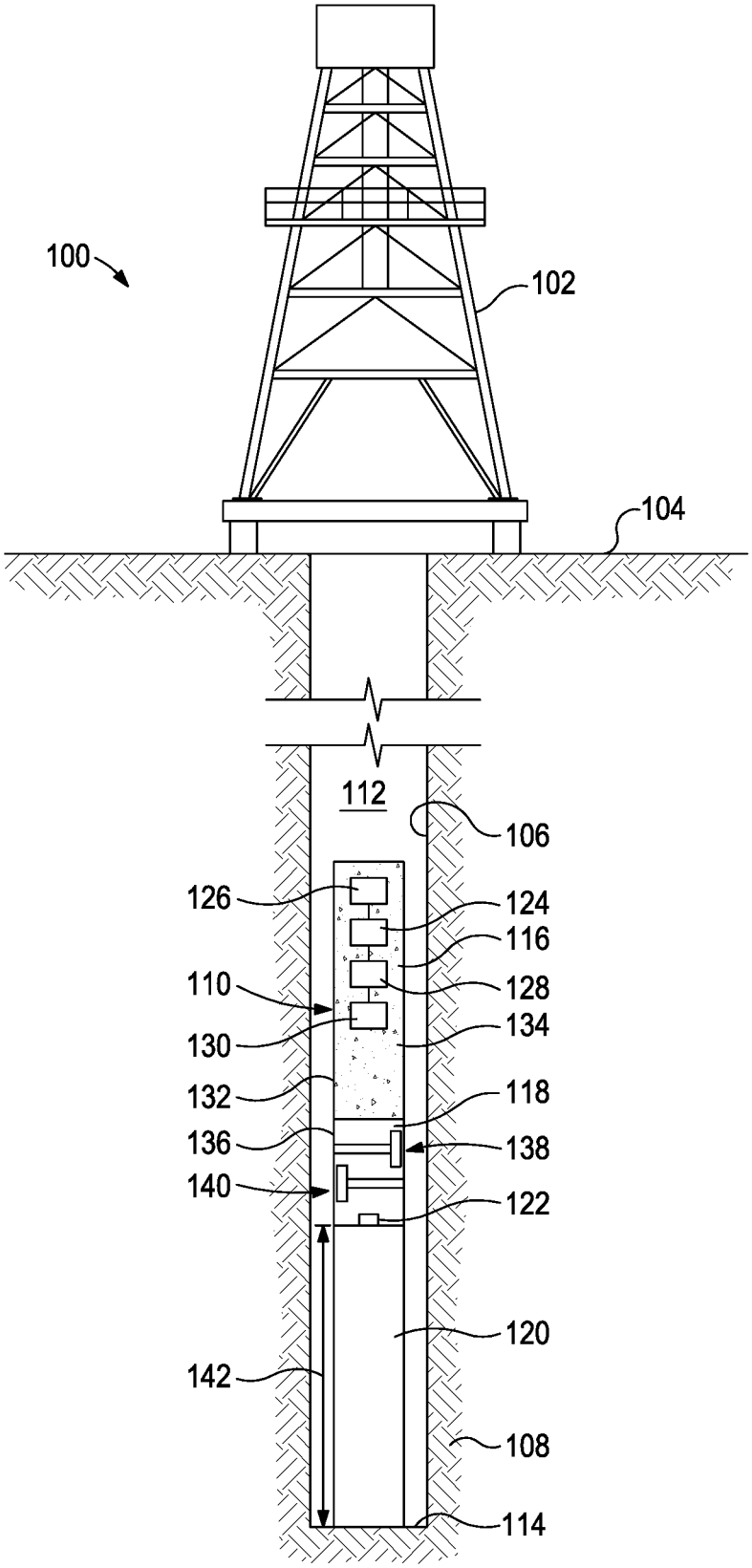
FIG. 1 is a schematic diagram of an example well system that may employ one or more principles of the present disclosure, according to one or more embodiments.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to core sampling in the oil and gas industry and, more particularly, to robotic, untethered sidewall coring tools and methods of deploying, operating, and retrieving the same. Embodiments disclosed herein describe robotic, sidewall coring tools operated as autonomous devices configured to obtain subterranean formation core samples from within a wellbore. The presently described tools are untethered from a well surface and launched into the wellbore to descend to the bottom of the well under gravitational forces. Once certain pre-set (predetermined) conditions are met, the coring mechanism in the tool may be activated and to drill and retrieve a sidewall core sample. The main body of the tool is constructed of a low-density, buoyant material and is electrically powered without hydraulics. After the coring operation has been completed, a weight bar (section) on the bottom of the tool is released, which immediately changes the buoyancy of the tool from negative to positive, thus allowing the tool and the retrieved core sample to rise to the surface. The presently described tools require minimal equipment and personnel to successfully operate.

FIG. 1 is a schematic diagram of an example well system 100 that may employ one or more principles of the present disclosure, according to one or more embodiments. As illustrated, the well system 100 may include a service rig 102 positioned on the Earth's surface 104 and extending over and around a wellbore 106 that penetrates a subterranean formation 108. The wellbore 106 may be drilled into the subterranean formation 108 using any suitable drilling technique and may extend in a substantially vertical direction away from the Earth's surface 104, alternately referred to herein as the "well surface location".

The service rig 102 may be a drilling rig, a completion rig, a workover rig, or the like. In some embodiments, the service rig 102 may be omitted and replaced with a standard surface wellhead completion or installation, without departing from the scope of the disclosure. Moreover, while the well system 100 is depicted as a land-based operation, it will be appreciated that the principles of the present disclosure could equally be applied to any offshore, sea-based, or sub-sea application where the service rig 102 may be a floating platform, a semi-submersible platform, or a subsurface wellhead installation as generally known in the art.

The system 100 may further include a coring tool 110 that may be conveyed into the wellbore 106 without the use of a conveyance, such as wireline, slickline, an electric line, coiled tubing, drill pipe, production pipe, etc. Rather, the coring tool 110 may be conveyed into the wellbore 106 using gravity or under gravitational force. Consequently, the coring tool 110 may be characterized or referred to herein as being "untethered," such as being physically untethered to any structure at the surface 104 or "well surface location".

The coring tool 110 may be cylindrical in shape and sized to be received within the wellbore 106. In some embodiments, as illustrated, the coring tool 110 may exhibit a generally polygonal cross-sectional shape (e.g., rectangular), with a length that is longer than its width (or diameter). Consequently, the coring tool 110 may be received within the wellbore 106 and extend generally perpendicular to the inner wall of the wellbore 106. The coring tool 110 may be assembled (e.g., "made-up") at the surface 104 and introduced into the wellbore 106, which may be filled with a wellbore fluid 112, such as drilling mud or water. Once released into the wellbore 106 at the surface 104, gravity will act on the coring tool 110 and urge the coring tool 110 to descend through the wellbore fluid 112 to a bottom 114 of the wellbore 106.

As illustrated, the coring tool 110 includes a first or "electronics" section 116, a second or "coring" section 118, and a third or "weight" section 120. In at least one embodiment, as illustrated, the electronics section 116 may be operatively coupled to an upper end of the coring section 118, and the weight section 120 may be operatively coupled to a lower end of the coring section 118. In other embodiments, however, the axial position of the electronics section 116 and the coring section 118 may be switched. In such embodiments, the weight section 120 will be operatively coupled to a lower end of the electronics section 116. In any event, the weight section 120 may be arranged at the bottom of the coring tool 110 and operatively coupled to the upper first and second sections 116, 118.

In at least one embodiment, the electronics section 116 and the coring section 118 may be housed within a monolithic carrier or housing that jointly encapsulates each section 116, 118. Alternatively, the electronics and coring sections 116, 118 may be separately assembled within corresponding housings and operatively coupled following individual assembly. In the illustrated embodiment, the weight section 120 is releasably coupled to the upper first and second sections 116, 118 (e.g., the coring section 118) using a release mechanism 122. As described in more detail below, upon meeting certain predetermined downhole conditions, the release mechanism 122 may be selectively triggered to separate the weight section 120 from the upper first and second sections 116, 118. Once the weight section 120 is released, the upper first and second sections 116, 118 may be configured to naturally ascend (float) back to the well surface 104, while the detached weight section 120 will remain at the bottom 114 of the wellbore 106.

The electronics section 116 may house or otherwise include various components and devices configured to autonomously operate the coring tool 110. For example, the electronics section 116 may house a control unit 124 that includes a processor and memory 126. The control unit 124 may comprise a computer or computer system, and the processor and memory 126 may be configured to store and execute computer-readable, programmable instructions for operating the coring tool 110.

The electronics section 116 may further include a power source 128 that provides electrical power to the various components housed within the electronics section 116. For example, the power source 128 may be in communication with the control unit 124 and the processor and memory 126. The power source 128 may also be configured to provide electrical power to various electromechanical devices provided in other parts of the coring tool 110, such as the release mechanism 122. The power source 128 may comprise any source of power capable of supplying sufficient electrical power for operating the coring tool 110 in a downhole environment. Examples of the power source 128 include, but are not limited to, one or more batteries, a set of rechargeable super capacitors, a fuel-cell, a downhole electric generator, or any combination thereof.

The electronics section 116 may further house or include a variety of sensors 130 powered by the power source 128 and in communication with the control unit 124. The sensors 130 may be configured to obtain measurements of various downhole conditions within the wellbore 106 i) as the coring tool 110 descends within the wellbore 106, ii) as the coring tool 110 operates, and iii) as the coring tool 110 returns to the surface 104. Example sensors 130 include, but are not limited to, a gamma ray sensor, a casing collar locator (CCL), a pressure sensor, and a temperature sensor. The gamma ray sensor and/or the CCL may be used to measure and confirm depth of the coring tool 110 within the wellbore 106, and the pressure and temperature sensors may be used to measure and determine the real-time pressure and temperature within the wellbore 106.

In some embodiments, specific depth, pressure, and temperature measurements obtained by the sensors 130 may comprise predetermined downhole conditions that must be met prior to activating the coring tool 110 for operation. For example, measurements obtained by the gamma ray sensor and/or the CCL can confirm that the coring tool 110 has reached a predetermined depth (i.e., the bottom 114), and when the pressure and temperature sensors indicate that the pressure and temperature within the wellbore 106 have stabilized, the coring tool 110 may then be activated (operated) to obtain a core sample.

The electronics section 116 may be housed within a cylindrical housing 132 that is either filled with or made of a buoyant material 134. In some embodiments, for example, the housing 132 may be made of a plastic material and filled with the buoyant material 134. In other embodiments, however, the housing 132 may alternatively be made of the buoyant material 134, which would be directly exposed to the wellbore fluid 112. The control unit 124, the processor and memory 126, the power source 128, and the sensors 130 may each be potted within the buoyant material 134.

The buoyant material 134 exhibits a density that is less than the density of water and oil, thus making the buoyant material 134 buoyant in the wellbore fluid 112. As a result, the buoyant material 134 constantly urges the electronics section 116 (and any other section operatively coupled thereto) to naturally float towards the surface 104 when immersed in the wellbore fluid 112. Moreover, the buoyant material 134 may be sufficiently buoyant to urge the electronics section 116 and the coring section 118 to float within the wellbore fluid 112 when coupled. The weight of the weight section 120, however, may be sufficient to overcome the buoyancy forces generated by the buoyant material 134, thus allowing the coring tool 110 to descend through the wellbore fluid 112 to the bottom 114 of the wellbore 106 when the weight section 120 is coupled to the upper sections 116, 118. Once the weight section 120 is detached, however, the buoyancy of the buoyant material 134 may lift the electronics section 116 and the coring section 118 within the wellbore fluid 112 and back to the surface 104.

The buoyant material 134 may comprise a variety of materials having a density less than the density of the wellbore fluid 112 (e.g., water and oil). The buoyant material 134 may also comprise a material suitable to withstand the pressures and temperatures commonly found in downhole environments and protect the electronics potted within. In some embodiments, for example, the buoyant material 134 may comprise a composite syntactic foam, which is made of pre-formed hollow ceramic spheres bound together in an ordered structure with a matrix resin. Syntactic foam exhibits high strength at low density with excellent buoyancy, and can handle high impact or shock. Moreover, syntactic foam is generally resistant to pressure and exposure to formation fluids (i.e., the wellbore fluid 112), and is suited to composite-metal joints in its fabrication process. Composite syntactic foam exhibits a density of 0.61 g/cm$^3$, and its pressure and temperature rating is 5200 psi and 180° C., respectively. The syntactic foam can be customized for a variety of applications, and its volume can be adjusted to achieve a desired buoyancy and ascent speed to the surface 104 of around 30 to 60 ft./min.

The coring section 118 may include a cylindrical housing 136 made of a rigid material capable of delivering the strength required to drill a sidewall core sample. The material of the housing 136 may also be light-weight to minimize weight and thereby assist the overall buoyancy of the coring tool 110. Example materials for the housing 136 of the coring section 118 include, but are not limited to, a light-weight, high-strength metal or metal alloy, a thermoplastic, a composite material, or any combination thereof. Example metal alloys include, but are not limited to, magnesium, titanium, and beryllium alloys.

As illustrated, the coring section 118 may include or otherwise house a sidewall coring unit 138 and a stabilizer arm assembly 140. As discussed in more detail below, the sidewall coring unit 138 may include a drilling motor operable to laterally advance and rotate a coring drill bit configured to penetrate the inner wall of the wellbore 106 and thereby obtain a core sample. The stabilizer arm assembly 140 may include a stabilizer motor operable to laterally advance a stabilizer arm out of the housing 136 and into engagement with the adjacent wall of the wellbore 106. The stabilizer arm may apply pressure against the formation to hold the coring tool 110, and more particularly, the coring section 118, in place during coring operations.

As mentioned above, the weight section 120 provides sufficient weight to overcome the buoyancy of the buoyant material 134 and thereby allow the coring tool 110 to descend within the wellbore 106 through the wellbore fluid 112 and to the bottom 114. Accordingly, the weight section 120 may exhibit a weight that is greater than the buoyancy forces generated by the buoyant material 134. Various dimensions of the weight section 120 (i.e., length, width, diameter, etc.) may be adapted to provide the required additional weight. Moreover, a length 142 of the weight section 120 can be determined such that a predetermined stand-off distance from the bottom 114 of the wellbore 106 is achieved. In such embodiments, the length 142 of the weight section 120 may determine the specific sampling depth of the coring section 118.

The weight section 120 may be made of any material exhibiting a weight greater than the buoyancy forces generated by the buoyant material 134. Example materials for the weight section 120 include, but are not limited to, a metal, a metal alloy, a ceramic, or any combination thereof.

In at least one embodiment, the weight section 120 may be made of a degradable or dissolvable material configured to dissolve in the wellbore fluid 112 (e.g., water). In such embodiments, the weight section 120 may be made of degradable metal or metal alloy, such as an aluminum alloy that is dissolvable in water over a known period of time. Other dissolvable materials suitable for the weight section 120 are mentioned herein below. In some embodiments, the dissolvable material will commence dissolving or degrading upon coming into contact with the wellbore fluid 112, and the dissolution process may require several hours to complete. The rate of dissolution of the material may depend on the specific alloy composition, the temperature within the wellbore 106, and the contents of the wellbore fluid 112.

The release mechanism 122 may be selectively triggered to separate the weight section 120 from the electronics and coring sections 116, 118. Once the weight section 120 is released, the electronics and coring sections 116, 118 may be free to naturally float back to the well surface 104 within the wellbore fluid 112, and the detached weight section 120 will remain at the bottom 114 of the wellbore 106. The release mechanism 122 may prove advantageous in avoiding the need to wait for the dissolvable material of the weight section 120 to dissolve. As will be appreciated, however, a balance needs to be found between the rate of dissolution of the material in the weight section 120 and the time required to obtain a core sample.

Figure 2:
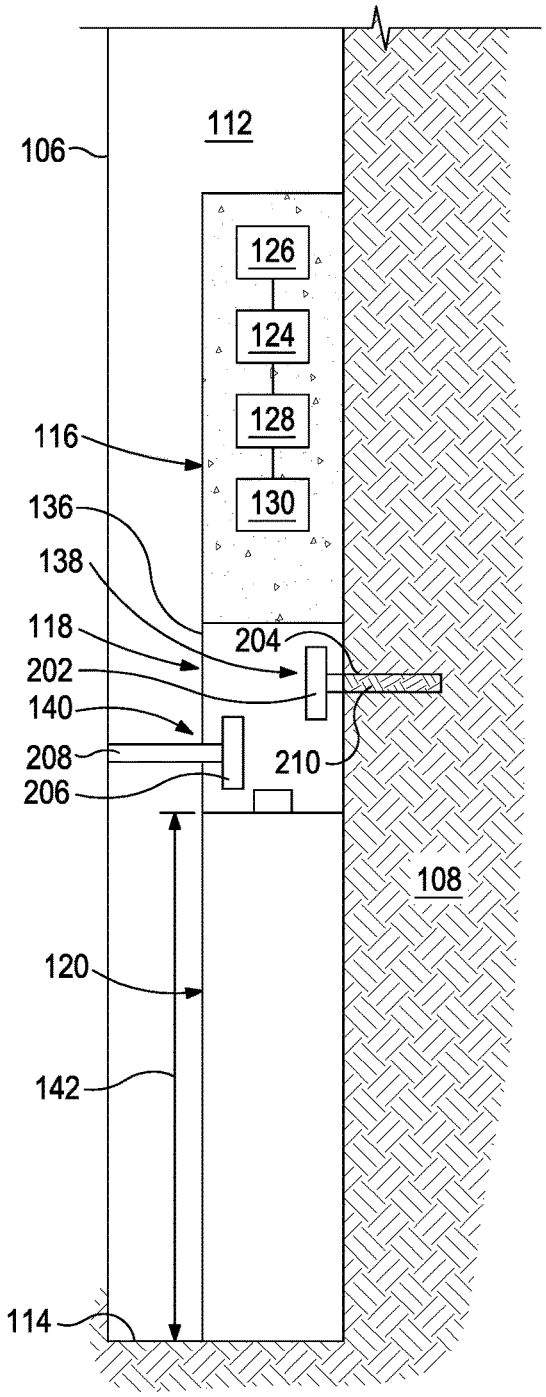
FIG. 2 is an enlarged schematic view of the coring tool of FIG. 1 during example operation, according to one or more embodiments.

FIG. 2 is an enlarged schematic view of the coring tool 110 during example operation, according to one or more embodiments. As discussed above, the coring tool 110 may be dropped into the wellbore 106 from the surface 104 (FIG. 1) and allowed to descend through the wellbore fluid 112 under gravitational force until reaching the bottom 114 of the wellbore 106. In some embodiments, the location of the bottom 114 may be known to the well operator based on drilling analysis and computation. Consequently, the depth at which a core sample is to be obtained using the coring tool 110 (e.g., the "sample depth) can be determined and set by adjusting a length of the coring tool 110 and, more particularly, the length 142 of the weight section 120.

Before deployment into the wellbore 106, the coring tool 110 may be programmed with certain predetermined ("preset") downhole conditions that must be recognized (measured) and met before the coring tool 110 can be activated for core sampling operation. More specifically, the processor and memory 126 arranged within the electronics section 116 may be programmed with and store the predetermined downhole conditions. The processor and memory 126 may also communicate with the sensors 130, which provide real-time downhole measurements that can be compared against the predetermined downhole conditions. Once the real-time downhole measurements meet or correspond to one or more of the predetermined downhole conditions, the control unit 124 may then be configured to trigger activation of the coring tool 110.

Example predetermined downhole conditions include, but are not limited to, a depth of the coring tool 110, a pressure within the wellbore 106, a temperature within the wellbore 106, travel time within the wellbore 106, or any combination thereof. For example, in some embodiments, prior to triggering operation of the coring tool 110, the coring tool 110 may be required to be located at the bottom 114 of the wellbore 106, which can be determined using the gamma ray sensor and/or the CCL included in the sensors 130.

In other embodiments, or in addition thereto, prior to triggering operation of the coring tool 110, the real-time pressure and/or temperature within the wellbore 106 where the coring tool 110 is located may be required to be stabilized, as measured by the pressure and temperature sensors in the sensors 130. Stable pressure and/or temperature may be an indication that the descent of the coring tool 110 has concluded and that the coring tool 110 is stationary within the wellbore 106. In such embodiments, it may be required that the stable pressure and/or temperature be measured over a set (predetermined) time period; e.g., 5 minutes, 10 minutes; 30 minutes, 1 hour, 2 hours, 5 hours, etc., any time period falling therebetween, any time period less than 5 minutes, or any time period greater than 5 hours.

In yet other embodiments, or in addition thereto, prior to triggering operation of the coring tool 110, it may be required that the coring tool 110 be present within the wellbore 106 for a set (predetermined) time period; e.g., 30 minutes, 1 hour, 2 hours, 5 hours, 10 hours, 24 hours (1 day), 2 days, 5 days, etc., any time period falling therebetween, any time period less than 30 minutes, or any time period greater than 5 days.

Once the one or more predetermined downhole conditions are met, as determined by the processor and memory 126, the control unit 124 may then be configured to communicate with the coring section 118 to commence activation of the coring tool 110. As discussed above, the coring section 118 includes the sidewall coring unit 138 and the stabilizer arm assembly 140. The sidewall coring unit 138 may include a drilling motor 202 and a coring drill bit 204, and the stabilizer arm assembly 140 may include a stabilizer motor 206 and at least one stabilizer arm 208.

Activating the coring tool 110 may include triggering activation of the stabilizer motor 206 and thereby laterally advancing the stabilizer arm 208 out of the housing 136 and into lateral engagement with the inner wall of the wellbore 106. The stabilizer motor 206 may be operable such that the stabilizer arm 208 applies a preset amount of force (pressure) against the formation wall and thereby forces the coring tool 110 against the opposite side formation wall. In at least one embodiment, the stabilizer arm 208 may apply sufficient force to hold the coring section 118 in place and against the formation wall during the coring operation.

Once the stabilizer arm 208 is extended and in contact with the inner wall of the wellbore 106, and the coring tool 110 is forced against the opposing side formation wall, the sidewall coring unit 138 may then be activated. More specifically, the drilling motor 202 may activated and laterally advance the coring drill bit 204 out of the housing 136 and into engagement with the inner wall of the wellbore. In some embodiments, the housing 136 may be double ported at 1800 to allow the coring drill bit 204 and the stabilizer arm 208 to extend from the housing 136 at angularly opposite locations on the housing 136. The drilling motor 202 may further be operable to simultaneously rotate the coring drill bit 204, which may be configured to penetrate the inner wall of the wellbore 106 as it rotates and thereby obtain a core sample 210 from the surrounding subterranean formation 108. In some embodiments, the coring drill bit 204 may comprise a hollow, cylindrical shaft having a bit head attached to its end. The core sample 210 may be housed (retained) within the cylindrical shaft.

Figure 3:
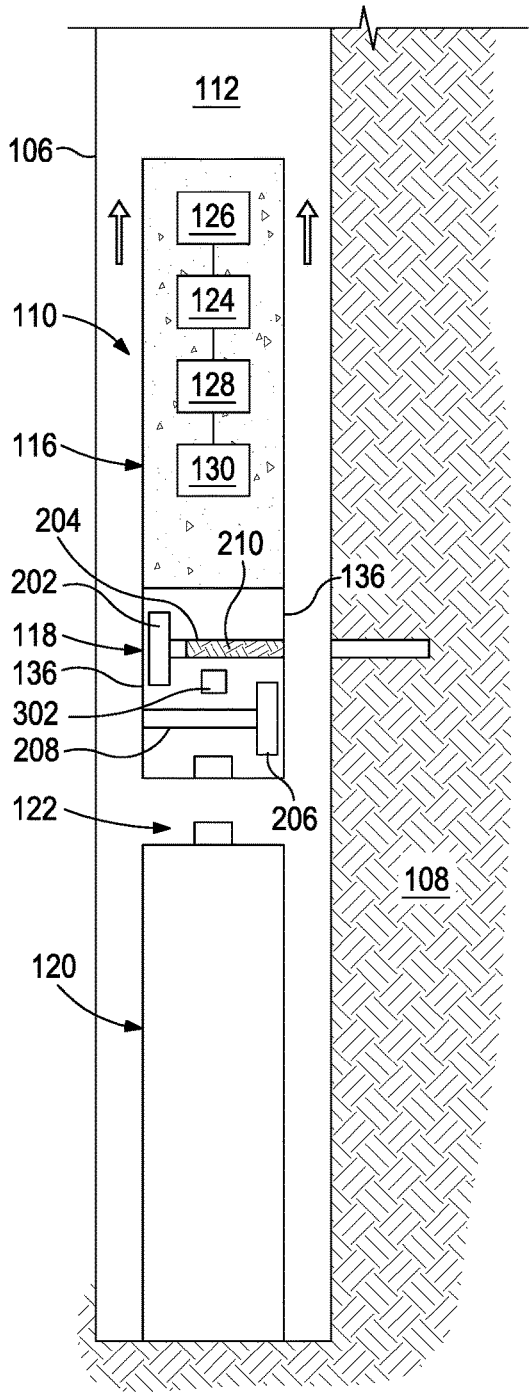
FIG. 3 is another enlarged schematic view of the coring tool of FIG. 1 following extraction of the core sample of FIG. 2, according to one or more embodiments.

FIG. 3 is another enlarged schematic view of the coring tool 110 following extraction of the core sample 210, according to one or more embodiments. Once the core sample 210 is obtained, the drilling motor 202 may be reversed to laterally retract the coring drill bit 204 back into the housing 136 of the coring section 118. This may stow the core sample 210 within the housing 136 in preparation for its return to the surface 104 (FIG. 1). Moreover, the stabilizer motor 206 may also be reversed to laterally retract the stabilizer arm 208 back into the housing 136 and thereby allow the coring tool 110 to disengage from the inner wall of the wellbore 106.

With coring drill bit 204 and the stabilizer arm 208 retracted and the core sample 210 properly stowed within the housing 136 of the coring section 118, the coring tool 110 may then be prepared to return to the surface 104 (FIG. 1). The release mechanism 122 may be in communication with the control unit 124, which may be configured to send a command signal to the release mechanism 122 when one or more release conditions are met. One release condition may include verification that the coring drill bit 204 and the stabilizer arm 208 are properly retracted and stowed within the housing 136 following extraction of the coring sample 210. In such embodiments, the coring section 118 may include one or more sensors 302 (e.g., proximity sensors) configured to detect and report the real-time position of the coring drill bit 204 and the stabilizer arm 208. The sensors 302 may be in communication with the control unit 124, and measurements reported to the control unit 124 may indicate whether the coring drill bit 204 and the stabilizer arm 208 are properly retracted and stowed within the housing 136.

Another release condition that may be required to be met before activating the release mechanism 122 may be a preset (predetermined) time limit of the coring tool 110 within the wellbore 106. More specifically, the coring tool 110 may be pre-programmed with a preset time limit for the coring tool 110 to be within the wellbore 106. Once the preset time limit is reached or surpassed, no matter if the core sample 210 is obtained or not, the release mechanism 122 may be triggered to release the weight section 120. This release condition may serve as a safety feature that prevents the coring tool 110 from residing within the wellbore 106 for long periods of time because of a malfunction of the electronics (e.g., the control unit 124) or otherwise to wait for the weight section 120 to dissolve and thereby reverse buoyancy of the coring tool 110. The preset time limit for activating the release mechanism 122 may be for example, 30 minutes, 1 hour, 2 hours, 5 hours, 10 hours, 24 hours (1 day), 2 days, 5 days, 10 days, etc., any time period falling therebetween, any time period less than 30 minutes, or any time period greater than 10 days.

Another release condition that may be required to be met before activating the release mechanism 122 may include a pressure and/or temperature threshold. In such embodiments, the coring tool 110 may be pre-programmed with certain pressure and temperature thresholds, and if the pressure and temperature sensors detect a pressure or temperature, respectively, that surpasses the certain pressure and/or temperature threshold, the release mechanism 122 may be triggered to release the weight section 120.

Yet another release condition that may be required to be met before activating the release mechanism 122 may include a low power signal detected from the power source 128. More particularly, the release mechanism 122 may be activated if the measured voltage of the power source 128 dips below a predetermined power limit threshold. This release condition may also serve as a safety feature and may be triggered even if none of the other release conditions have been met or if the core sample 210 is obtained or not.

Still referring to FIG. 3, the coring tool 110 is shown following activation of the release mechanism 122, with the weight section 120 disconnected and otherwise separated from the upper electronics and coring sections 116, 118. The release mechanism 122 may comprise any type of device or mechanism configured to selectively disconnect (release) the weight section 120 from the upper electronics and coring sections 116, 118. In some embodiments, for example, the release mechanism 122 may comprise an electro-mechanical release mechanism in communication with the control unit 124. For example, the release mechanism 122 may include an electric motor or servo and a mechanical release operable by the motor/servo.

An additional example of the release mechanism 122 is a magnetic weight release mechanism. The magnetic weight release mechanism may include two opposing magnets of roughly the same size, and a boost converter circuit. One of the magnets may be attached to the weight section 120 and comprise a neodymium-iron-boron (NIB) magnet with high coercivity, and the opposing magnet may be attached to one of the adjacent upper sections 116, 118 and comprise an aluminum-nickel-cobalt (AlNiCo) magnet with low coercivity. When the weight section 120 is coupled to the upper sections 116, 118, the magnets are arranged next to each other, and a coil is wound around the magnet assembly to apply an external magnetic field and alter the polarization of the AlNiCo magnet. The polarization of the NIB magnet remains unchanged due to its coercivity. When both magnets have the same polarization direction, they act similar to a single magnet pulling a metal weight. When the polarizations are in opposite directions, magnetic field lines cancel each other within a short distance because of similar permeance of the magnets, thus diminishing the pull force.

A boost converter circuit may be included in the magnetic weight release mechanism to create the necessary external magnetic field for repolarization of the AlNiCo magnet. This circuitry receives power from the power source 128 to charge a capacitor bank, and once the capacitor bank is charged, a short electrical pulse is created by discharging the capacitors through the coil surrounding the magnets. The resulting magnetic field is strong enough to change the polarization of the AlNiCo magnet. Unlike electromagnets, this design consumes energy only to change the magnetic polarization state and does not require energy to keep its new state.

Once the weight section 120 is released, as shown in FIG. 3, the buoyancy of the coring tool 110 is immediately changed from negative to positive, thus allowing the separated electronics and coring sections 116, 118 to naturally float within the wellbore fluid 112 and back to the well surface 104 (FIG. 1) to be received by a surface capture sub or the like. The expected rate of ascent may depend on the hydrodynamics of the ascending portion of the coring tool 110, and also on the ratio of the buoyancy of the upper sections 116, 118 and the viscosity of the wellbore fluid 112. This ratio can be adjusted to achieve a particular target ascent rate suitable for particular applications. In at least one embodiment, for example, the ratio may be adjusted to achieve a target ascent rate of about 60 ft./min. In contrast, the detached weight section 120 will remain at the bottom 114 of the wellbore 106. In embodiments where the weight section 120 comprises a dissolvable material, the weight section will eventually dissolve and its dissolution time may be estimated based on conditions within the wellbore 106 and the particular dissolvable material employed.

Figure 4A:
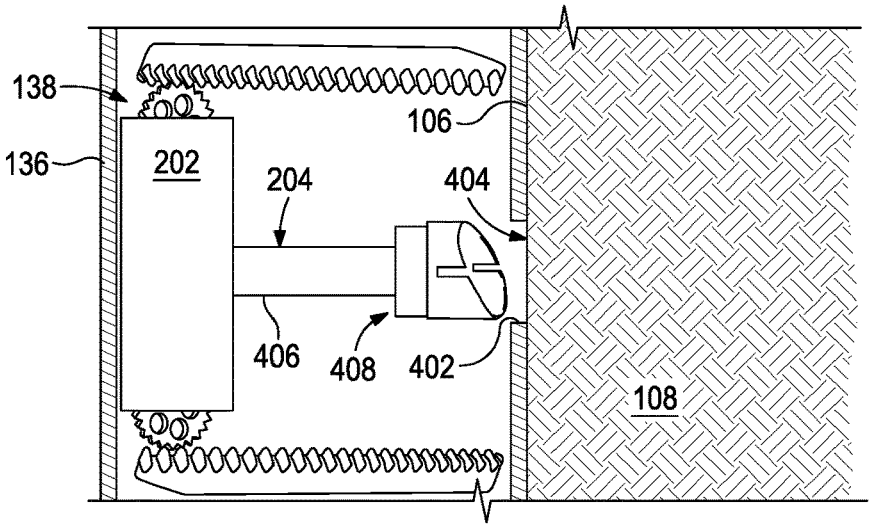
FIGS. 4A-4D are enlarged schematic views of example operation of the sidewall coring unit of FIGS. 1-3, according to one or more embodiments.

FIGS. 4A-4D are enlarged schematic views of example operation of the sidewall coring unit 138, according to one or more embodiments. Referring first to FIG. 4A, as discussed above, the sidewall coring unit 138 may include the drilling motor 202 operable to laterally advance the coring drill bit 204 out of the housing 136 while simultaneously rotating the coring drill bit 204 to penetrate the surrounding subterranean formation 108. As illustrated, the coring drill bit 204 extends laterally from the drilling motor 202, and the housing 136 may define a first aperture or port 402 through which the coring drill bit 204 can extend to engage the surrounding subterranean formation 108 at an inner wall 404 of the wellbore 106.

In some embodiments, the drilling motor 202 may comprise a compact, sealed, direct-drive, high-speed electric motor powered by the power source 128 (FIGS. 1-3). An electric-powered, direct drive drilling motor 202 may be an efficient means of transferring maximum power to the coring drill bit 204, and may thus be configured to deliver the force required to advance and rotate the coring drill bit 204. Other types of motors, however, may be employed, without departing from the scope of the disclosure.

The coring drill bit 204 may include a hollow, cylindrical shaft 406 with a bit head 408 coupled to an end of the shaft 406. The shaft 406 may be designed to receive and retain the drilled core sample 210 (see FIGS. 4B-4D), and the bit head 408 may be made of or include a hard or ultra-hard material configured to drill through (into) the subterranean formation 108. Examples of the hard or ultra-hard material include, but are not limited to, natural or synthetic diamond, polycrystalline diamond, thermally stable polycrystalline (TSP) diamond, tungsten carbide, or any combination thereof. Such hard or ultra-hard materials may ensure the coring will be completed quickly and help avoid sticking of the bit head 408, particularly in hard rock formations.

Figure 4B:
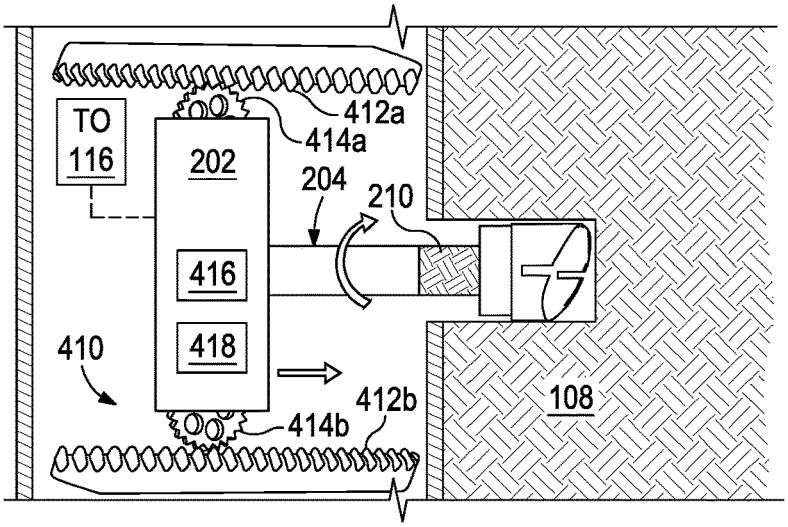

In FIG. 4B, the sidewall coring unit 138 is shown with the coring drill bit 204 advanced laterally a short distance into the surrounding subterranean formation 108 and thereby starting to obtain the core sample 210. The drilling motor 202 may be in communication with the electronics section 116, and may thus be operated by signals communicated by the control unit 124 (FIGS. 1-3) and powered by the power source 128 (FIGS. 1-3). Upon receiving a command signal from the control unit 124, the drilling motor 202 may be activated to laterally advance and simultaneously rotate the coring drill bit 204.

The sidewall coring unit 138 includes a drilling propulsion system 410 operable by the drilling motor 202 to laterally advance the coring drill bit 204. In the illustrated embodiment, the drilling propulsion system 410 includes upper and lower rails 412*a* and 412*b*, and the drilling motor 202 is mounted between the upper and lower rails 412*a,b* with upper and lower, direct-drive wheel assemblies 414*a* and 414*b*, respectively. The wheel assemblies 414*a,b* are rotatably mounted to the drilling motor 202, which is operable to drive the wheel assemblies 414*a,b* against the adjacent rails 412*a,b* respectively, and thereby laterally move the coring drill bit 204. In the illustrated embodiment, the rails 412*a,b* and the wheel assemblies 414*a,b* each define intermeshing teeth (e.g., gear teeth) that allow the wheel assemblies 414*a,b* to drive against the rails 412*a,b*. In such embodiments, the drilling propulsion system 410 may operate similar to a rack and pinion gear engagement. In other embodiments, however, the teeth may be omitted and the wheel assemblies 414*a,b* may instead engage the rails 412*a,b* in other ways sufficient to propel the drilling motor 202 and the coring drill bit 204 laterally.

The drilling propulsion system 410 may further include a rotatable drive mechanism 416 housed within the drilling motor 202 and in communication with the electronics section 116, and thus in communication with the control unit 124 (FIGS. 1-3). Upon receiving a command signal from the control unit 124, the rotatable drive mechanism 416 may be actuatable to rotate the coring drill bit 204 in either angular direction.

In some embodiments, the sidewall coring unit 138 may further include a compression sensor 418 in communication with the electronics section 116, and thus in communication with the control unit 124 (FIGS. 1-3). The compression sensor 418 may be configured to measure the compression force imparted to (assumed by) the coring drill bit 204 during operation. Drill bit stalling can occur as a result of excessive compressive force imparted to (assumed by) the coring drill bit 204. Based on measurements obtained by the compression sensor 418, the control unit 124 may operate the drilling motor 202 to control the forward force applied during drilling and thereby reduce the risk of drill bit stalling.

Figure 4C:
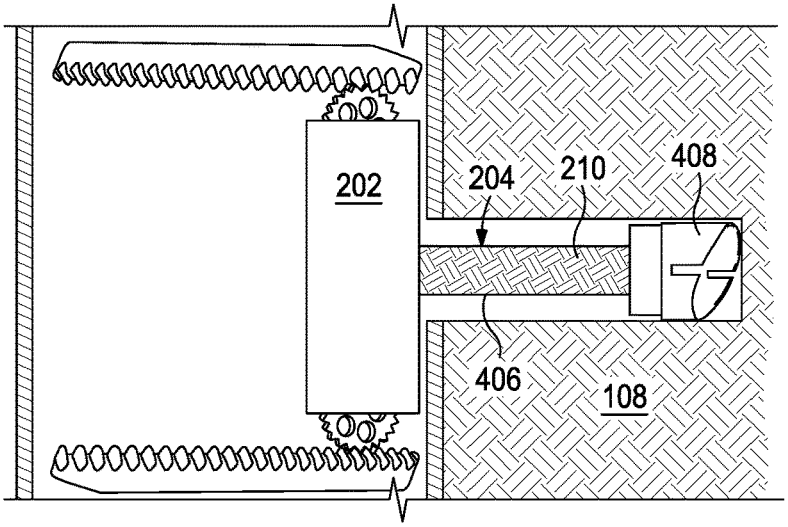

In FIG. 4C, the drilling motor 202 and the coring drill bit 204 have advanced forward to full extension, thus penetrating the surrounding subterranean formation 108 to obtain the full core sample 210. As will be appreciated, the resulting size of the core sample 210 may be based on the size of the bit head 408 and the cylindrical shaft 406 of the coring drill bit 204. In some embodiments, the diameter of the extracted core sample 210 may be between about 1 inch and about 1.5 inches, and the length of the core sample 210 may be between about 2 inches and about 4 inches, but the diameter and length could be other sizes depending on the dimensions of the coring drill bit 204.

Figure 4D:
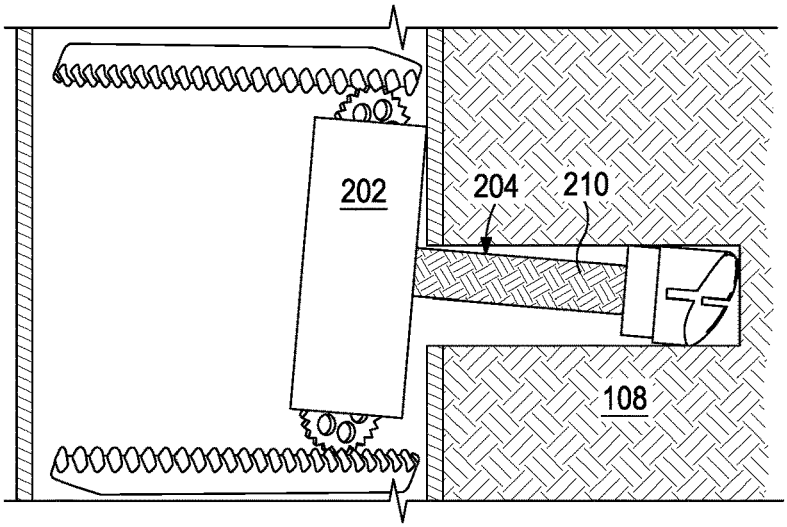

In FIG. 4D, once drilling the core sample 210 is completed, the coring drill bit 204 may be tilted to break off (shear) the end of the core sample 210 from the subterranean formation 108. This is accomplished by actuating one of the wheel assemblies 414*a,b* in a forward direction (e.g., clockwise), while actuating the other of the wheel assemblies 414*a,b* in the reverse direction (e.g., counter-clockwise). This will result in the drilling motor 202 and the coring drill bit 204 tilting by a fixed amount to shear off the core sample 210. Once the core sample 210 is successfully sheared from the subterranean formation 108, the tilted orientation of the coring drill bit 204 may be reversed back to the normal operating orientation and the drilling motor 202 may be actuated to retract (reverse) the coring drill bit 204 back into the housing 136, thus properly stowing the extracted core sample 210.

Figure 5A:
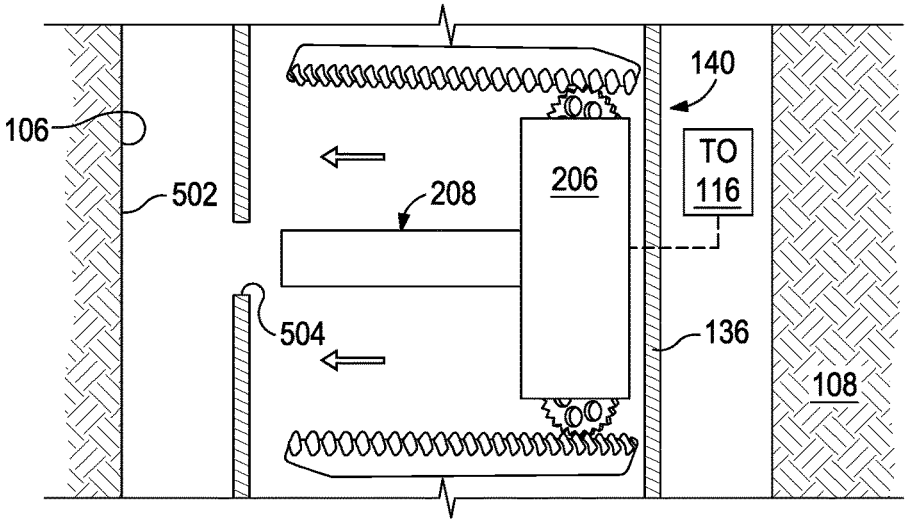
FIGS. 5A and 5B are enlarged schematic views of example operation of the stabilizer arm assembly of FIGS. 1-3, according to one or more embodiments.
Figure 5B:
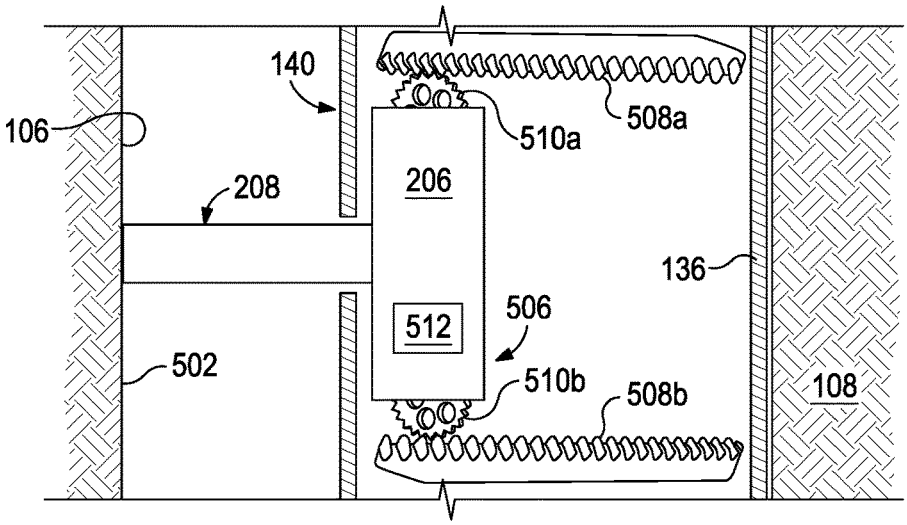

FIGS. 5A and 5B are enlarged schematic views of example operation of the stabilizer arm assembly 140, according to one or more embodiments. Referring first to FIG. 5A, as discussed above, the stabilizer arm assembly 140 may include the stabilizer motor 206 operable to laterally advance the stabilizer arm 208 out of the housing 136 to engage an inner wall 502 of the wellbore 106. As illustrated, the stabilizer arm 208 extends laterally from the stabilizer motor 206, and the housing 136 may define a second aperture or port 504 through which the stabilizer arm 208 can extend to engage the inner wall 502 of the wellbore 106. As mentioned above, the housing 136 may be double ported at 1800 to allow the coring drill bit 204 (FIGS. 4A-4D) and the stabilizer arm 208 to extend from the housing 136 at angularly opposite locations on the housing 136. Accordingly, the first and second ports 402 (FIG. 4A), 504 may be defined in the housing 136 on angularly opposite sides. This may prove advantageous in allowing the stabilizer arm 208 to engage the inner wall 502 of the wellbore 502 and urge the housing 136 into engagement with the angularly opposite side of the wellbore 106, which allows the coring drill bit 204 to immediately penetrate the subterranean formation 108 upon exiting the first port 402.

Similar to the drilling motor 202 (FIGS. 4A-4D), the stabilizer motor 206 may comprise a compact, sealed, direct-drive, high-speed electric motor. Moreover, the stabilizer motor 206 may also be in communication with the electronics section 116, and may thus be operated by signals communicated by the control unit 124 (FIGS. 1-3) and powered by the power source 128 (FIGS. 1-3). Upon receiving a command signal from the control unit 124, the stabilizer motor 206 may be activated to laterally advance the stabilizer arm 208.

In FIG. 5B, the stabilizer arm assembly 140 is shown advanced laterally to full extension and otherwise until the stabilizer arm 208 engages the inner wall 502 of the wellbore 106. As mentioned above, engaging the stabilizer arm 208 against the inner wall 502 of the wellbore 106, may help force the housing 136 against the angular opposite side of the wellbore 106 in preparation for drilling.

The stabilizer arm assembly 140 may include a stabilizer propulsion system 506 operable by the stabilizer motor 206 to laterally advance the stabilizer arm 208. Similar to the drilling propulsion system 410 (FIG. 4B) of the sidewall coring unit 138 (FIGS. 4A-4D), the stabilizer propulsion system 506 can include upper and lower rails 508*a* and 508*b*, and the stabilizer motor 206 is mounted between the upper and lower rails 508*a,b* with upper and lower, direct-drive wheel assemblies 510*a* and 510*b*, respectively. The wheel assemblies 510*a,b* are rotatably mounted to the stabilizer motor 206, which is operable to drive the wheel assemblies 510*a,b* against the adjacent rails 508*a,b* respectively, and thereby advance and retract the stabilizer arm 208. In the illustrated embodiment, the rails 508*a,b* and the wheel assemblies 510*a,b* each define intermeshing teeth that allow the wheel assemblies 510*a,b* to drive against the rails 508*a,b*. In other embodiments, however, the teeth may be omitted and the wheel assemblies 510*a,b* may instead engage the rails 508*a,b* in other ways sufficient to propel the stabilizer motor 206 and the stabilizer arm 208 laterally.

In some embodiments, the stabilizer arm assembly 140 may further include a compression sensor 512 in communication with the electronics section 116, and thus in communication with the control unit 124 (FIGS. 1-3). The compression sensor 512 may be configured to measure the compression force imparted to (assumed by) the stabilizer arm 208 during operation, and thus provide feedback on how much torque can be applied by the stabilizer propulsion system 506 to maintain the housing 136 against the angular opposite side of the wellbore 106 during drilling. Once drilling is completed, the stabilizer motor 206 may be actuated to retract (reverse) the stabilizer arm 208 back into the housing 136.

Degradable (Dissolvable) Materials

Referring again to FIG. 1, as discussed above, the weight section 120 may be made of a degradable or dissolvable material. The terms "degradable" and "dissolvable" may be used herein interchangeably. The term "degradable" and all of its grammatical variants (e.g., "degrade," "degradation," "degrading," and the like) refers to the dissolution or chemical conversion of materials into smaller components, intermediates, or end products by at least one of solubilization, hydrolytic degradation, biologically formed entities (e.g., bacteria or enzymes), chemical reactions (including electrochemical reactions), thermal reactions, or reactions induced by radiation. In some instances, the degradation of the material may be sufficient for the mechanical properties of the material to be reduced to a point that the material no longer maintains its integrity and, in essence, falls apart or sloughs off. The conditions for degradation or dissolution are generally wellbore conditions where an external stimulus may be used to initiate or effect the rate of degradation. For example, the pH of the fluid that interacts with the material may be changed by the introduction of an acid or a base.

The degradation rate of a given dissolvable material may be accelerated, rapid, or normal, as defined herein. Accelerated degradation may be in the range of from a lower limit of about 30 minutes, 1 hour, 2 hours, 3 hours, 4 hours, 5 hours, and 6 hours to an upper limit of about 12 hours, 11 hours, 10 hours, 9 hours, 8 hours, 7 hours, and 6 hours, encompassing any value or subset therebetween. Rapid degradation may be in the range of from a lower limit of about 12 hours, 1 day, 2 days, 3 days, 4 days, and 5 days to an upper limit of about 10 days, 9 days, 8 days, 7 days, 6 days, and 5 days, encompassing any value or subset therebetween. Normal degradation may be in the range of from a lower limit of about 10 days, 11 days, 12 days, 13 days, 14 days, 15 days, 16 days, 17 days, 18 days, 19 days, 20 days, 21 days, 22 days, 23 days, 24 days, 25 days, and 26 days to an upper limit of about 40 days, 39 days, 38 days, 37 days, 36 days, 35 days, 34 days, 33 days, 32 days, 31 days, 30 days, 29 days, 28 days, 27 days, and 26 days, encompassing any value or subset therebetween. Accordingly, degradation of the dissolvable material may be between about 30 minutes to about 40 days, depending on a number of factors including, but not limited to, the type of dissolvable material selected, the conditions of the wellbore environment, and the like.

As indicated above, one example degradable material that may comprise the weight section 120 is a degradable metal or metal alloy, such as an aluminum alloy that is dissolvable in water over a known period of time. Other suitable dissolvable or degradable materials that may be used in accordance with the embodiments of the present disclosure include dissolvable metals, galvanically-corrodible metals, degradable polymers, a degradable rubber, borate glass, polyglycolic acid (PGA), polylactic acid (PLA), dehydrated salts, and any combination thereof. Suitable dissolvable materials may also include an epoxy resin exposed to a caustic solution, fiberglass exposed to an acid, aluminum exposed to an acidic fluid, and a binding agent exposed to a caustic or acidic solution. The dissolvable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the dissolvable material of aqueous or hydrocarbon fluids present within the wellbore environment such that the mechanical properties of the dissolvable material degrade or fail. In degradation by swelling, the dissolvable material continues to absorb the aqueous and/or hydrocarbon fluid until its mechanical properties are no longer capable of maintaining the integrity of the dissolvable material and it at least partially falls apart. In some embodiments, the dissolvable material may be designed to only partially degrade by swelling in order to ensure that the mechanical properties of the component formed from the dissolvable material is sufficiently capable of lasting for the duration of the specific operation in which it is utilized.

Example aqueous fluids that may be used to swell and degrade the dissolvable material include, but are not limited to, fresh water, saltwater (e.g., water containing one or more salts dissolved therein), brine (e.g., saturated salt water), seawater, acid, bases, or combinations thereof. Example hydrocarbon fluids that may swell and degrade the dissolvable material include, but are not limited to, crude oil, a fractional distillate of crude oil, a saturated hydrocarbon, an unsaturated hydrocarbon, a branched hydrocarbon, a cyclic hydrocarbon, and any combination thereof.

Degradation by dissolving involves a dissolvable material that is soluble or otherwise susceptible to an aqueous fluid or a hydrocarbon fluid, such that the aqueous or hydrocarbon fluid is not necessarily incorporated into the dissolvable material (as is the case with degradation by swelling), but becomes soluble upon contact with the aqueous or hydrocarbon fluid.

Degradation by undergoing a chemical change may involve breaking the bonds of the backbone of the dissolvable material (e.g., a polymer backbone) or causing the bonds of the dissolvable material to crosslink, such that the dissolvable material becomes brittle and breaks into small pieces upon contact with even small forces expected in the wellbore environment.

Thermal degradation of the dissolvable material involves a chemical decomposition due to heat, such as heat that may be present in a wellbore environment. Thermal degradation of some dissolvable materials mentioned or contemplated herein may occur at wellbore environment temperatures that exceed about 93° C. (or about 200° F.).

With respect to dissolvable or galvanically-corrodible metals used as a dissolvable material, the metal may be configured to degrade by dissolution in the presence of an aqueous fluid or via an electrochemical process in which a galvanically-corrodible metal corrodes in the presence of an electrolyte (e.g., brine or other salt-containing fluids). Suitable dissolvable or galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. Suitable galvanically-corrodible metals also include a nano-structured matrix galvanic materials. One example of a nano-structured matrix micro-galvanic material is a magnesium alloy with iron-coated inclusions. Suitable galvanically-corrodible metals also include micro-galvanic metals or materials, such as a solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which causes micro-galvanic corrosion and degradation. Micro-galvanically corrodible magnesium alloys could also be solution structured with other elements such as zinc, aluminum, nickel, iron, carbon, tin, silver, copper, titanium, rare earth elements, etcetera. Micro-galvanically corrodible aluminum alloys could be in solution with elements such as nickel, iron, carbon, tin, silver, copper, titanium, gallium, et cetera. Of these galvanically-corrodible metals, magnesium and magnesium alloys may be preferred.

With respect to degradable polymers used as a dissolvable material, a polymer is considered "degradable" or "dissolvable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present invention include polysaccharides such as dextran or cellulose, chitins, chitosans, proteins, aliphatic polyesters, poly(lactides), poly(glycolides), poly(F-caprolactones), poly(hydroxybutyrates), poly(anhydrides), aliphatic or aromatic polycarbonates, poly(orthoesters), poly(amino acids), poly(ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof.

Polyanhydrides are another type of particularly suitable degradable polymer useful in the embodiments of the present disclosure. Polyanhydrides hydrolyze in the presence of aqueous fluids to liberate the constituent monomers or comonomers, yielding carboxylic acids as the final degradation products. The erosion time can be varied over a broad range of changes to the polymer backbone, including varying the molecular weight, composition, or derivatization. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Suitable degradable rubbers include degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other suitable degradable polymers include those that have a melting point that is such that it will dissolve at the temperature of the subterranean formation in which it is placed.

In some embodiments, the dissolvable material may have a thermoplastic polymer embedded therein. The thermoplastic polymer may modify the strength, resiliency, or modulus of the component and may also control the degradation rate of the component. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly(m-methylstyrene), poly(p-methylstyrene), poly(2,4-dimethylstyrene), poly(2,5-dimethylstyrene), poly(p-tert-butylstyrene), poly(p-chlorostyrene), poly(α-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in the dissolvable material forming the component may be any amount that confers a desirable elasticity without affecting the desired amount of degradation. In some embodiments, the thermoplastic polymer may be included in an amount in the range of a lower limit of about 1%, 5%, 10%, 15%, 20%, 25%, 30%, 35%, 40%, and 45% to an upper limit of about 91%, 85%, 80%, 75%, 70%, 65%, 60%, 55%, 50%, and 45% by weight of the dissolvable material, encompassing any value or subset therebetween.

Computer Systems

Figure 6:
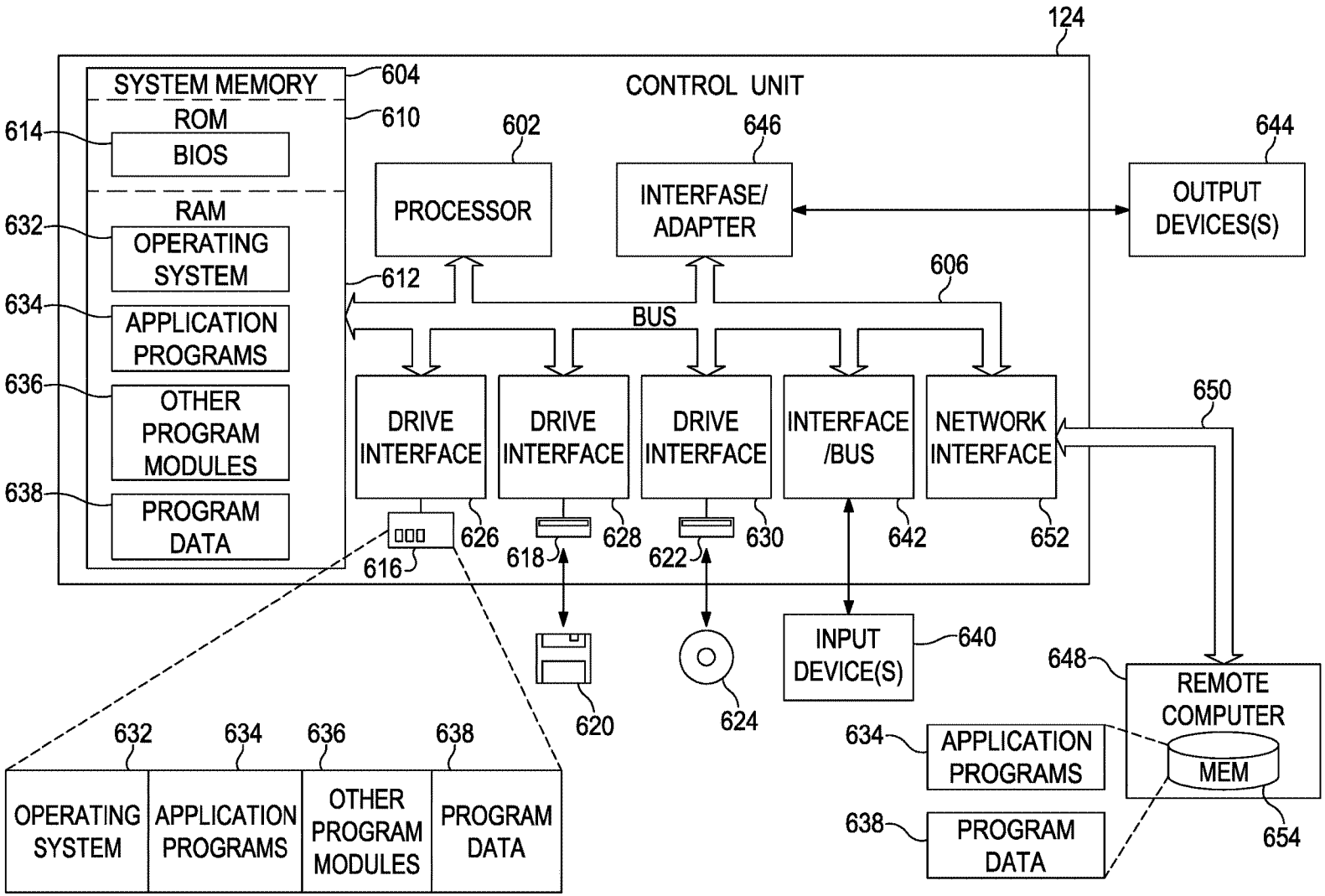
FIG. 6 is a schematic diagram of an example of the control unit of FIGS. 1-3, according to one or more embodiments

FIG. 6 is a schematic diagram of one example of the control unit 124, according to one or more embodiments. In view of the foregoing structural and functional description, those skilled in the art will appreciate that portions of the embodiments may be embodied as a method, data processing system, or computer program product operable by the control unit 124. Accordingly, these portions of the present embodiments may take the form of an entirely hardware embodiment, an entirely software embodiment, or an embodiment combining software and hardware, such as shown and described in FIG. 6. Furthermore, portions of the embodiments may be a computer program product on a computer-usable storage medium having computer readable program code on the medium. Any non-transitory, tangible storage media possessing structure may be utilized including, but not limited to, static and dynamic storage devices, hard disks, optical storage devices, and magnetic storage devices, but excludes any medium that is not eligible for patent protection under 35 U.S.C. § 101 (such as a propagating electrical or electromagnetic signal per se). As an example and not by way of limitation, a computer-readable storage media may include a semiconductor-based circuit or device or other IC (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. A computer-readable non-transitory storage medium may be volatile, nonvolatile, or a combination of volatile and non-volatile, where appropriate.

Certain embodiments have also been described herein with reference to methods and systems. It will be understood that the presently disclosed methods can be implemented by computer-executable instructions. These computer-executable instructions may be provided to one or more processor of a general purpose computer, special purpose computer, or other programmable data processing apparatus (or a combination of devices and circuits) to produce a machine, such that the instructions, which execute via the processor, implement the functions specified in the block or blocks.

These computer-executable instructions may also be stored in computer-readable memory that can direct a computer or other programmable data processing apparatus to function in a particular manner, such that the instructions stored in the computer-readable memory result in an article of manufacture including instructions which implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart block or blocks.

In this regard, FIG. 6 illustrates one example of the control unit 124 that can be employed to execute one or more embodiments of the present disclosure. The control unit 124 can be implemented on one or more general purpose networked computer systems, embedded computer systems, routers, switches, server devices, client devices, various intermediate devices/nodes or standalone computer systems. Additionally, the control unit 124 can be implemented on various mobile clients such as, for example, a personal digital assistant (PDA), laptop computer, pager, and the like, provided it includes sufficient processing capabilities.

The control unit 124 includes processing unit 602 and system memory 601, which combined may comprise the processor and memory 126 described above with reference to FIGS. 1-3. The control unit 124 may further include a system bus 606 that couples various system components, including the system memory 604, to processing unit 602. Dual microprocessors and other multi-processor architectures also can be used as processing unit 602. System bus 606 may be any of several types of bus structure including a memory bus or memory controller, a peripheral bus, and a local bus using any of a variety of bus architectures. System memory 604 includes read only memory (ROM) 610 and random access memory (RAM) 612. A basic input/output system (BIOS) 614 can reside in ROM 610 containing the basic routines that help to transfer information among elements within the control unit 124.

The control unit 124 can include a hard disk drive 616, magnetic disk drive 618, e.g., to read from or write to removable disk 620, and an optical disk drive 622, e.g., for reading CD-ROM disk 624 or to read from or write to other optical media. Hard disk drive 616, magnetic disk drive 618, and optical disk drive 622 are connected to system bus 606 by a hard disk drive interface 626, a magnetic disk drive interface 628, and an optical drive interface 630, respectively. The drives and associated computer-readable media provide nonvolatile storage of data, data structures, and computer-executable instructions for control unit 124. Although the description of computer-readable media above refers to a hard disk, a removable magnetic disk and a CD, other types of media that are readable by a computer, such as magnetic cassettes, flash memory cards, digital video disks and the like, in a variety of forms, may also be used in the operating environment; further, any such media may contain computer-executable instructions for implementing one or more parts of embodiments shown and described herein.

A number of program modules may be stored in drives and RAM 610, including operating system 632, one or more application programs 634, other program modules 636, and program data 638. The application programs 634 and program data 638 can include functions and methods programmed to measure downhole properties, operate the coring tool, and activate the release mechanism, such as shown and described herein.

A user may enter commands and information into the control unit 124 through one or more input devices 640, such as a pointing device (e.g., a mouse, touch screen), keyboard, microphone, joystick, game pad, scanner, and the like. These and other input devices 640 are often connected to processing unit 602 through a corresponding port interface 642 that is coupled to the system bus, but may be connected by other interfaces, such as a parallel port, serial port, or universal serial bus (USB). One or more output devices 644 (e.g., display, a monitor, printer, projector, or other type of displaying device) is also connected to system bus 606 via interface 646, such as a video adapter.

The control unit 124 may operate in a networked environment using logical connections to one or more remote computers, such as remote computer 648. Remote computer 648 may be a workstation, computer system, router, peer device, or other common network node, and typically includes many or all the elements described relative to control unit 124. The logical connections, schematically indicated at 650, can include a local area network (LAN) and a wide area network (WAN). When used in a LAN networking environment, control unit 124 can be connected to the local network through a network interface or adapter 652. When used in a WAN networking environment, control unit 124 can include a modem, or can be connected to a communications server on the LAN. The modem, which may be internal or external, can be connected to system bus 606 via an appropriate port interface. In a networked environment, application programs 634 or program data 638 depicted relative to computer system 300, or portions thereof, may be stored in a remote memory storage device 654.

Embodiments disclosed herein include:

A. A well system can include a wellbore extending from a well surface location and penetrating a subterranean formation, the wellbore being filled with a wellbore fluid, and a coring tool untethered from the well surface location and conveyable to a bottom of the wellbore under gravitational forces. The coring tool can include an electronics section that includes a buoyant material that is buoyant in the wellbore fluid, a coring section coupled to the electronics section and including a sidewall coring unit operable to penetrate an inner wall of the wellbore and thereby obtain a core sample, and a weight section operatively coupled to the electronics and coring sections at a release mechanism. A weight of the weight section may overcome buoyancy forces generated by the buoyant material in the wellbore fluid, and activating the release mechanism detaches the weight section and allows the electronics and coring sections to float to the well surface location.

A coring tool can include an electronics section that includes a buoyant material that is buoyant in a wellbore fluid, and a coring section coupled to the electronics section. The coring section may include a sidewall coring unit operable to penetrate an inner wall of a wellbore and thereby obtain a core sample, and a stabilizer arm assembly operable to laterally extend a stabilizer arm into engagement with the inner wall of the wellbore. The coring tool may further include a weight section operatively coupled to the electronics and coring sections and exhibiting a weight that overcomes buoyancy forces generated by the buoyant material in the wellbore fluid, and a release mechanism that releasably attaches the weight section to the electronics and coring sections, wherein activating the release mechanism detaches the weight section, thereby allowing the electronics and coring sections to float in the wellbore fluid and ascend the wellbore.

A method of operating a well system can include introducing a coring tool into a wellbore extending from a well surface location and penetrating a subterranean formation, the wellbore being filled with a wellbore fluid and the coring tool being untethered from the well surface location. The coring tool may include an electronics section that includes a buoyant material that is buoyant in the wellbore fluid, a coring section coupled to the electronics section and including a stabilizer arm assembly and a sidewall coring unit, and a weight section operatively coupled to the electronics and coring sections and exhibiting a weight that overcomes buoyancy forces generated by the buoyant material in the wellbore fluid. The method may further include conveying the coring tool toward a bottom of the wellbore under gravitational forces, activating a release mechanism and thereby detaching the weight section from the electronics and coring sections, and floating the electronics and coring sections to the well surface location.

Each of embodiments A, B, and C may have one or more of the following additional elements in any combination: Element 1: wherein the electronics section houses a control unit that includes a processor and memory, one or more sensors in communication with the control unit and operable to measure and report one or more downhole conditions within the wellbore, and a power source that provides electrical power to operate the coring tool. Element 2: wherein the control unit is programmed to compare one or more predetermined downhole conditions against the one or more downhole conditions measured by the one or more sensors, and wherein the sidewall coring unit is activated when the one or more downhole conditions meet at least one of the one or more predetermined downhole conditions. Element 3: wherein the one or more predetermined downhole conditions are selected from the group consisting of a depth of the coring tool within the wellbore, a pressure within the wellbore, a temperature within the wellbore, travel time within the wellbore, and any combination thereof. Element 4: wherein the release mechanism is in communication with the control unit, and the control unit is programmed to send a command signal to activate the release mechanism upon the coring tool meeting one or more release conditions. Element 5: wherein the one or more release conditions are selected from the group consisting of i) verification that a coring drill bit of the sidewall coring unit and a stabilizer arm of a stabilizer arm assembly included in the coring section are retracted following extraction of the coring sample, ii) a preset time limit of the coring tool residing within the wellbore, iii) a pressure threshold, iv) a temperature threshold, and v) a low power signal detected from the power source. Element 6: wherein the coring section further comprises a stabilizer arm assembly operable to laterally extend a stabilizer arm into engagement with the inner wall of the wellbore and thereby maintain the coring section stationary during operation of the sidewall coring unit. Element 7: wherein the dissolvable metal comprises an aluminum alloy.

Element 8: wherein the electronics section houses a control unit that includes a processor and memory, one or more sensors in communication with the control unit and operable to measure and report one or more downhole conditions within the wellbore, and a power source that provides electrical power to operate the coring tool. Element 9: wherein the one or more sensors are selected from the group consisting of a gamma ray sensor, a casing collar locator, a pressure sensor, and a temperature sensor. Element 10: wherein the power source is selected from the group consisting of one or more batteries, a set of rechargeable super capacitors, a fuel-cell, a downhole electric generator, and any combination thereof. Element 11: wherein the release mechanism is in communication with the control unit, and the control unit is programmed to send a command signal to activate the release mechanism upon the coring tool meeting one or more release conditions. Element 12: wherein the buoyant material comprises a composite syntactic foam. Element 13: wherein the sidewall coring unit includes a drilling motor and a coring drill bit extending laterally from the drilling motor, and the stabilizer arm assembly includes a stabilizer motor and the stabilizer arm extends laterally from the stabilizer motor, and wherein the sidewall coring unit and the stabilizer arm assembly are arranged within a housing that defines a first port aligned with the coring drill bit and a second port aligned with the stabilizer arm and angularly offset from the first port by 180°. Element 14: wherein the sidewall coring unit includes a drilling propulsion system operable by the drilling motor to laterally move the coring drill bit, and wherein the stabilizer arm assembly includes a stabilizer propulsion system operable by the stabilizer motor to laterally move the stabilizer arm. Element 15: wherein the weight section is made of a dissolvable material selected from the group consisting of a dissolvable metal, a galvanically-corrodible metals, a degradable polymer, a degradable rubber, borate glass, polyglycolic acid, polylactic acid, a dehydrated salt, and any combination thereof.

Element 16: wherein activating the release mechanism is preceded by engaging the coring tool against the bottom of the wellbore, comparing one or more predetermined downhole conditions against one or more downhole conditions as measured by one or more sensors included in the electronics section, confirming that at least one of the one or more predetermined downhole conditions is met, activating the stabilizer arm assembly and thereby laterally extending a stabilizer arm into engagement with an inner wall of the wellbore, activating the sidewall coring unit and thereby advancing a coring drill bit into the subterranean formation to obtain a core sample, and retracting the stabilizer arm and the coring drill bit. Element 17: wherein activating the release mechanism is further preceded by the coring tool meeting one or more release conditions selected from the group consisting of i) verification that the coring drill bit and the stabilizer arm are retracted, ii) a preset time limit of the coring tool residing within the wellbore, iii) a pressure threshold, iv) a temperature threshold, and v) a low power signal detected from a power source included in the electronics section.

By way of non-limiting example, exemplary combinations applicable to A, B, and C include: Element 1 with Element 2; Element 2 with Element 3; Element 1 with Element 4; Element 4 with Element 5; Element 8 with Element 9; Element 8 with Element 10; Element 8 with Element 11; Element 13 with Element 14; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a wellbore extending from a well surface location and penetrating a subterranean formation, the wellbore being filled with a wellbore fluid; and a coring tool untethered from the well surface location and conveyable to a bottom of the wellbore under gravitational forces, the coring tool including:

an electronics section that includes a buoyant material that is buoyant in the wellbore fluid;

a coring section coupled to the electronics section and including a sidewall coring unit operable to penetrate an inner wall of the wellbore and thereby obtain a core sample; and a weight section operatively coupled to the electronics and coring sections at a release mechanism, wherein an elongated weight of the weight section overcomes buoyancy forces generated by the buoyant material in the wellbore fluid and engages the bottom of the wellbore to define a stand-off distance between the bottom of the wellbore and the sidewall coring unit, and wherein activating the release mechanism detaches the weight section and allows the electronics and coring sections to float to the well surface location.

2. The well system of claim 1, wherein the electronics section houses:

a control unit that includes a processor and memory;

one or more sensors in communication with the control unit and operable to measure and report one or more downhole conditions within the wellbore; and a power source that provides electrical power to operate the coring tool.

3. The well system of claim 2, wherein the control unit is programmed to compare one or more predetermined downhole conditions against the one or more downhole conditions measured by the one or more sensors, and wherein the sidewall coring unit is activated when the one or more downhole conditions meet at least one of the one or more predetermined downhole conditions.

4. The well system of claim 3, wherein the one or more predetermined downhole conditions are selected from the group consisting of a depth of the coring tool within the wellbore, a pressure within the wellbore, a temperature within the wellbore, travel time within the wellbore, and any combination thereof.

5. The well system of claim 2, wherein the release mechanism is in communication with the control unit, and the control unit is programmed to send a command signal to activate the release mechanism upon the coring tool meeting one or more release conditions.

6. The well system of claim 5, wherein the one or more release conditions are selected from the group consisting of:

i) verification that a coring drill bit of the sidewall coring unit and a stabilizer arm of a stabilizer arm assembly included in the coring section are retracted following extraction of the coring sample;

ii) a preset time limit of the coring tool residing within the wellbore;

iii) a pressure threshold;

iv) a temperature threshold; and v) a low power signal detected from the power source.

7. The well system of claim 1, wherein the coring section further comprises a stabilizer arm assembly operable to laterally extend a stabilizer arm into engagement with the inner wall of the wellbore and thereby maintain the coring section stationary during operation of the sidewall coring unit.

8. The well system of claim 1, wherein the weight is constructed of a dissolvable aluminum alloy.

9. A coring tool, comprising:

an electronics section that includes a buoyant material that is buoyant in a wellbore fluid;

a coring section coupled to the electronics section and including:

a sidewall coring unit operable to penetrate an inner wall of a wellbore and thereby obtain a core sample; and a stabilizer arm assembly operable to laterally extend a stabilizer arm into engagement with the inner wall of the wellbore;

a weight section operatively coupled to the electronics and coring sections and including an elongated weight that extends from a lower end of a lower one of the electronics and coring sections to define a stand-off distance between a bottom of the wellbore and the sidewall coring unit, wherein a weight of the elongated weight overcomes buoyancy forces generated by the buoyant material in the wellbore fluid; and a release mechanism that releasably attaches the weight section to the electronics and coring sections, wherein activating the release mechanism detaches the weight section, thereby allowing the electronics and coring sections to float in the wellbore fluid and ascend the wellbore.

10. The coring tool of claim 9, wherein the electronics section houses:

a control unit that includes a processor and memory having one or more downhole conditions stored thereon and indicative of the elongated weight engaged with the bottom of the wellbore stored thereon;

one or more sensors in communication with the control unit and operable to measure and report the one or more downhole conditions measured within the wellbore; and a power source that provides electrical power to operate the coring tool.

11. The coring tool of claim 10, wherein the one or more sensors are selected from the group consisting of a gamma ray sensor, a casing collar locator, a pressure sensor, and a temperature sensor.

12. The coring tool of claim 10, wherein the power source is selected from the group consisting of one or more batteries, a set of rechargeable super capacitors, a fuel-cell, a downhole electric generator, and any combination thereof.

13. The coring tool of claim 10, wherein the release mechanism is in communication with the control unit, and the control unit is programmed to send a command signal to activate the release mechanism upon the coring tool meeting one or more release conditions.

14. The coring tool of claim 9, wherein the buoyant material comprises a composite syntactic foam.

15. The coring tool of claim 9, wherein the sidewall coring unit includes a drilling motor and a coring drill bit extending laterally from the drilling motor, and the stabilizer arm assembly includes a stabilizer motor and the stabilizer arm extends laterally from the stabilizer motor, and wherein the sidewall coring unit and the stabilizer arm assembly are arranged within a housing that defines a first port aligned with the coring drill bit and a second port aligned with the stabilizer arm and angularly offset from the first port by 180°.

16. The coring tool of claim 15, wherein the sidewall coring unit includes a drilling propulsion system operable by the drilling motor to laterally move the coring drill bit, and wherein the stabilizer arm assembly includes a stabilizer propulsion system operable by the stabilizer motor to laterally move the stabilizer arm.

17. The coring tool of claim 9, wherein the weight section is made of a dissolvable material selected from the group consisting of a dissolvable metal, a galvanically-corrodible metals, a degradable polymer, a degradable rubber, borate glass, polyglycolic acid, polylactic acid, a dehydrated salt, and any combination thereof.

18. A method of operating a well system, comprising:

introducing a coring tool into a wellbore extending from a well surface location and penetrating a subterranean formation, the wellbore being filled with a wellbore fluid and the coring tool being untethered from the well surface location, the coring tool including:

an electronics section that includes a buoyant material that is buoyant in the wellbore fluid;

a coring section coupled to the electronics section and including a stabilizer arm assembly and a sidewall coring unit; and a weight section operatively coupled to the electronics and coring sections and providing an elongated weight that overcomes buoyancy forces generated by the buoyant material in the wellbore fluid;

conveying the coring tool toward a bottom of the wellbore under gravitational forces;

engaging the elongated weight against the bottom of the wellbore to define a stand-off distance between the bottom of the wellbore and the sidewall coring unit;

activating a release mechanism and thereby detaching the weight section from the electronics and coring sections; and floating the electronics and coring sections to the well surface location.

19. The method of claim 18, wherein activating the release mechanism is preceded by:

comparing one or more predetermined downhole conditions indicative of the elongated weight engaged with the bottom of the wellbore against one or more downhole conditions as measured by one or more sensors included in the electronics section;

confirming that at least one of the one or more predetermined downhole conditions is met;

activating the stabilizer arm assembly and thereby laterally extending a stabilizer arm into engagement with an inner wall of the wellbore;

activating the sidewall coring unit and thereby advancing a coring drill bit into the subterranean formation to obtain a core sample; and retracting the stabilizer arm and the coring drill bit.

20. The method of claim 19, wherein activating the release mechanism is further preceded by the coring tool meeting one or more release conditions selected from the group consisting of:

i) verification that the coring drill bit and the stabilizer arm are retracted;

ii) a preset time limit of the coring tool residing within the wellbore;

iii) a pressure threshold;

iv) a temperature threshold; and v) a low power signal detected from a power source included in the electronics section.

* * * * *